United States Patent [19]

Vorgrimler et al.

[11] 3,967,530

[45] July 6, 1976

[54] DEVICE FOR CONTROLLING THE FIRING CURRENT OF A QUICK-FIRING WEAPON

[75] Inventors: Ludwig Vorgrimler, Oberndorf (Neckar); Klaus Vorgrimler, Grunwettersbach, both of Germany

[73] Assignee: Industriewerke Karlsruhe-Augsburg Aktiengesellschaft, Germany

[22] Filed: Oct. 9, 1973

[21] Appl. No.: 405,626

[30] Foreign Application Priority Data

Jan. 4, 1973 Germany ..... 2300260

[52] U.S. Cl. ..... 89/135; 89/1 K

[51] Int. Cl.[2] ..... F41D 11/08; F41D 11/10

[58] Field of Search ..... 42/84; 89/28, 135

[56] References Cited

UNITED STATES PATENTS

| | | | |
|---|---|---|---|
| 3,451,307 | 6/1969 | Grundberg | 89/135 |
| 3,505,927 | 4/1970 | Driscoll | 89/135 |

*Primary Examiner*—Stephen C. Bentley

*Attorney, Agent, or Firm*—McGlew and Tuttle

[57] ABSTRACT

A blowback-operated quick-firing weapon is to fire at a preselected rate of firing or at its inherent rate of firing if the latter rate is smaller than the former one. This is achieved by substantially all-electronic elements such as gates and flip-flops. To this end there is a signal transmitter signalling the closed position of the slider of said weapon. A first circuit means produces a firing current control impulse. A second circuit means responds to the movement of the slider away from and back to its closed position and produces a first control signal. A third circuit means is triggered by the firing current control pulse through a time-delay element. A logic circuit combines the first and second control signals to trigger a firing currrent control pulse. Further means are provided to automatically cause the firing of a charging cartridge, if the shot cartridge has not fired within a preselected safety interval after the firing current control pulse.

5 Claims, 2 Drawing Figures

DEVICE FOR CONTROLLING THE FIRING CURRENT OF A QUICK-FIRING WEAPON

FIELD AND BACKGROUND OF THE INVENTION

This invention relates to a device for controlling the firing current of a blowback-operated, electrically fired quick-firing weapon, comprising a signal transmitter signalling the closed position of the slider.

A quick-firing weapon comprises a mechanism, which feeds each cartridge and pushes it into the barrel, closes a breech and automatically ejects the empty cartridge after the shot has been fired. Conventionally the breech is a slider. In prior art quick-firing weapons, firing is effected electrically by means of a firing current. A signal transmitter in the form of a slider contact monitors the closed position of the slider and prevents the triggering of the shot, if the slider is not in its closed position. In prior art quick-firing weapons in aircraft, the mechanism is driven by a motor and is thus positively actuated. Such a drive motor has to apply high power with the usual high rates of firing. Therefore, it has to be undesirably bulky and heavy and represents a considerable load on the aircraft electrical power supply. Another problem arising in a quick-firing weapon having a breech mechanism positively actuated by a motor is the following. It can happen, though only at a very low percentage, that a cartridge fires only after a noticeable firing delay. With a quick-firing weapon having a motor actuated breech-mechanism this can result in the not-yet-fired cartridge being ejected rather than the empty cartridge case, this cartridge then firing outside the weapon in a cartridge case receptacle. This would, of course, be a highly dangerous malfunction.

Therefore prior art quick-firing weapons used as aircraft arms have been designed as blowback-operated weapons. In this type of quick-firing weapons the breech-mechanism is actuated by the blowback of the preceding shot. This makes sure that the breech-mechanism is not operated to eject the cartridge case before the cartridge in the barrel has fired. However this type of quick-firing weapon would result in a failing cartridge, i.e. a cartridge which does not fire at all, making the weapon inoperative. In this case in the absence of blowback the breech-mechanism would not be actuated anymore and the non-fired cartridge would remain in the barrel.

For this reason, a charging cartridge is provided. If no firing of the cartridge and no actuation of the breech-mechanism takes place after the firing circuit has been closed, which is monitored by the slider contact, the charging cartridge will be fired after a preselected time delay through a time-delay relay. The gas pressure or blowback of this charging cartridge then causes, instead of the blowback of the shot cartridge, the breech-mechanism to be actuated. The failing cartridge is ejected. The weapon is charged with a fresh cartridge and the normal operating cycle of the weapon is restored. The delay time of the time-delay relay is selected to be longer than the maximum firing lag of the cartridge, for example, 300 milliseconds. This makes sure that no cartridge firing with lag can be ejected by means of the charging cartridge. Such a charging process makes the weapon again operative after failure of a cartridge. It is, of course, still not impossible that a still further failure occurs subsequently. For this case provision has to be made to enable a further charging process, i.e. a plurality of charging cartridge has to be provided, which are moved in succession into operative position by a charging mechanism. This results in further problems.

The rate of firing of the weapon is determined by the mechanical characteristics (mass, resiliency etc.) of the breech-mechanism and by the occuring gas pressures, which depend, among others, on the munition used. With a purely blowback-operated weapon, there will be an inherent rate of firing which may be variable within certain limits and may have undesirably high values. Also the charging mechanism for feeding the charging cartridge would have such an inherent rate of firing, which, however, due to the smaller mass is considerably higher than the inherent rate of firing of the weapon itself. This would have the result that, after a charging process, the next charging cartridge would be in its operative position very quickly, for example after 7.5 milliseconds, and would be fired by the, then still applied, charging pulse. Thus there would be the risk of double-charging. In order to avoid this, the time and duration of the charging impulse would have to be determined with high accuracy. This cannot be achieved with the relay circuits used in prior art electrically fired quick-firing weapons.

SUMMARY OF THE INVENTION

It is an object of the invention to limit the rate of firing of a quick-firing weapon of the type defined in the beginning to a preselected value. If the inherent rate of firing of the weapon is higher than the said preselected value, the weapon is to fire in a forcedly synchronized manner at the said preselected rate of firing. Otherwise it is to fire at its inherent rate of firing, i.e. as quick as it is able to fire.

In accordance with the invention the device for controlling the firing current of the blowback-operated and electrically fired quick-firing weapon is characterized by:

a. a first circuit means for producing a firing current control pulse,
b. a second circuit means responding to the movement of the slider away from and back to its closed position and producing a first control signal,
c. a third circuit means triggered by the firing current control pulse through a time-delay element and producing a second control signal, and
d. a logic circuit for combining the first and second control signals to trigger a firing current control pulse.

The invention uses a blowback-operated quick-firing weapon. Thus the cartridge is not automatically ejected by means of a motor operated mechanism but will not be ejected before the cartridge has fired. Accidents due to ejection of cartridges firing with time-delay are avoided thereby. In contrast to prior art quick-firing weapons of this type, however, there is a forced synchronization of the weapon, so that it operates at a well-defined preselected rate of firing, provided that the inherent rate of firing is higher than such preselected rate of firing. In this case, after the shot, the slider will, at first, be returned to its closed position and the second circuit means produces the first control signal. The firing current control pulse will, however, be produced only after also the third circuit means has been triggered through the time-delay element and provides the second control signal. This time-delay element determines the preselected rate of firing of the weapon.

If the inherent rate of firing of the weapon is smaller than the rate of firing determined by the time-delay element, first the second control signal will be produced by the third circuit means. The firing current control pulse will, however, be produced only after also the second circuit means has responded and produces the first control signal, i.e. after the slider has completed its movement after the preceding shot and has returned into its closed position. Under these condition, the weapon shoots at its inherent rate of firing, i.e. as quick as it can.

Prior to firing the shot, the slider is not moved and the cartridge cannot be ejected. Thus the invention combines the advantages of a blowback-operated weapon, with regard to safety and low external power consumption, and the advantage of a normally well-defined rate of firing.

A further object of the invention is to construct a control device of the present type with substantially all-electronic elements, in order to achieve a high degree of reliability and exactly defined time sequences of the various switching operations and, for example, to eliminate the influence of contact chatter.

For this purpose, the first circuit means may comprise a monostable flip-flop which is connected to be triggered by the control signals through an AND-gate. A second monostable flip-flop may be connected to be triggered by the firing current control pulse, the metastable output of the second monostable flip-flop being connected to control the firing current to a shot cartridge, and the second circuit means may comprise a bistable flip-flip having a dynamic input and connected to be set by a signal from the slider monitoring signal transmitter and to be reset by a change of state of the second monostable flip-flop. The third circuit means may comprise a bistable flip-flop connected to be set by the output from a third monostable flip-flop upon the return thereof to its stable state, the third monostable flip-flop being triggered by the firing current control pulse and serving as the time-delay element, the third bistable flip-flop being further connected to be reset by a change of state of the second monostable flip-flop.

In such a device, the bistable flip-flop of the second circuit means is reliably reset by the output of the second monostable flip-flop when firing pulse to the shot cartridge is produced. Only after the signal transmitter has responded, for example a slider contact has opened as a result thereof, signalling the actual firing of the shot, and subsequently is closed again, the bistable flip-flop is set again through its dynamic input by the end slope of the pulse received from the slider contact. The bistable flip-flop of the third circuit means is set by the monostable flip-flop serving as a time-delay element, a preselected time after the last firing current control impulse. As soon as the two bistable flip-flops have been set, the monostable flip-flop of the first circuit means will be triggered through the AND-gate to produce a pulse of preselected duration as a firing current control pulse.

If, in spite of the firing pulse from the said second monostable flip-flop, the shot is not fired, the slider contact will remain closed. After the bistable flip-flop of the second circuit means has been reset, there will be no new setting through the dynamic input and, consequently, no firing current control pulse will be produced.

The charging upon non-firing of the cartridge can be controlled in that, on one hand, the firing pulse to the shot cartridge is triggered by the firing current control pulse and, on the other hand, a restartable monostable flip-flop having a hold time, which safely exceeds the maximum occurring firing lag, is connected to be triggered by the firing current control pulse, a firing impulse to the charging cartridge being triggered by the end slope of the output pulse from this latter monostable flip-flop.

As long as the firing current control pulse appears, the restartable monostable flip-flop will be permanently triggered anew and remains in its metastable state. When the firing current control pulses cease, this monostable flip-flop returns to its stable state, after a safety period has elapsed, and triggers the firing of the charging cartridge. This charging causes the slider contact to open and to close again, whereby the bistable flip-flop of the second circuit means is set again and the next firing current control pulse is triggered. Due to the control being all-electronic, the moments and durations of the switching operations and pulses are exactly defined even with high rates of firing. Therefore it is possible to provide a plurality of charging cartridges adapted to be fed in succession to an operative position, without running the risk of double-charging.

In order to achieve operation of the weapon at selected different rates of firing, two monostable flip-flops having different hold times may be connected to be triggered in parallel by the firing current control pulse, the bistable flip-flop of the third circuit means being connected to be selectively set by the output from one of these monostable flip-flops through a controlled gate means.

BRIEF DESCRIPTION OF THE DRAWINGS

An embodiment of the invention is described in more detail hereinbelow with reference to the accompanying drawings.

DETAILED DESCRIPTION OF THE PREFERRED EMBODIMENT

Figure 1:
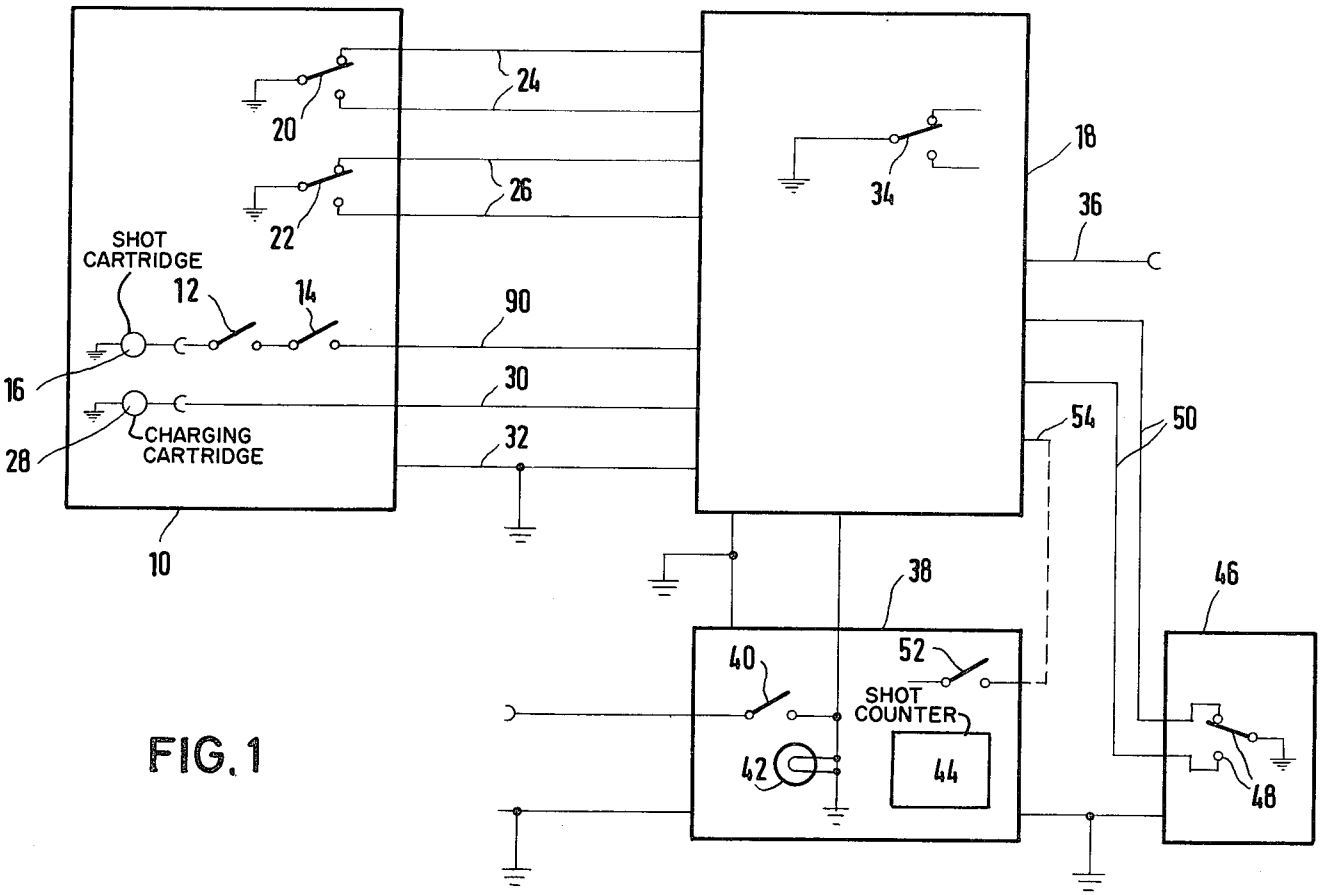
FIG. 1 is a block diagram of a quick-firing weapon having a control device of the invention.

Referring to FIG. 1, numeral 10 designates a quick-firing weapon the design of which is well-known to anybody skilled in the art and is no object of the present invention and which, therefore, is represented only as a block. A barrel contact 12 and a first slider contact 14 connected in series therewith are provided on weapon 10, these contacts being open, respectively, if the barrel of the weapon is not mounted properly and the head slide is not in its closed position.

These two contacts are series connected in the firing circuit to a shot cartridge 16 and prevent triggering of the shot if the aforementioned conditions are not fulfilled, independently of the electronic control device. A second slider contact 20 is provided for this control device and is actuated simultaneously with contact 14, the control device being represented by block 18 in FIG. 1 and being shown in detail in FIG. 2. Contact 20 is referred to when the term "slider contact" is used hereinbelow. A further contact 22 on the weapon is arranged to be actuated when a cartridge is in its operative position. This contact 22 will be called "counting contact". Contacts 20 and 22 are designed as change-over contacts, each contact grounding, in each position, one connection conductor out of a pair 24 and 26, respectively, of conductors. These connecting conductors are connected to control device 18. In addition, a charging cartridge 28 is arranged in the weapon to be fired by control device 18 through a conductor 30. Numeral 32 designates the common ground conductor. The weapon is blowback-operated. A plurality of charging cartridge are arranged to be fed in succession into an operative position and to be fired through conductor 30.

A switch 34 for manually triggering the charging process is connected in the electronic control device. External triggering, for example from a speed allowance computer, can be effected through an input 36.

The supply voltage of 28 volts is applied through a main switch 40 located on the instrument panel. Closing of this main switch, whereby the weapon is made live, is indicated by means of a pilot lamp 42 located on the instrument panel. In addition, a shot counter 44 is located on the instrument panel.

Triggering of the weapon is effected by means of a trigger 48, provided on the aircraft control stick 46 and designed as a change-over switch. Trigger 48 is connected to the control device 18 through a pair of conductors 50.

An inhibit input 54 can be energized by shot counter 44 through a switch 52, whereby the weapon is automatically switched off after a preselected number of shots, which corresponds to the munition supply.

Figure 2:
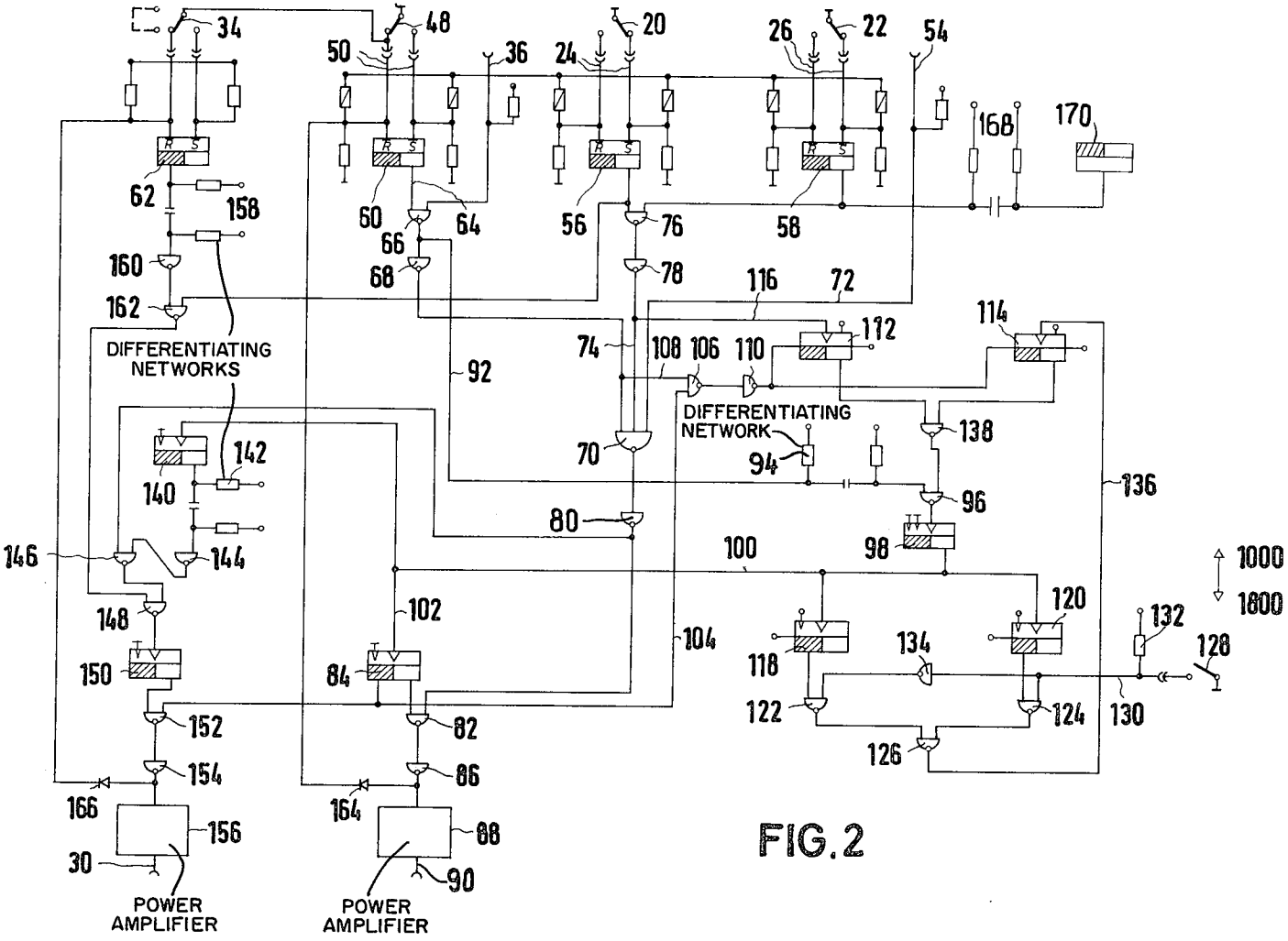
FIG. 2 is a diagram of the electronic control device of the invention.

FIG. 2 shows the electronic control device in detail. In order to get well-defined signals and to eliminate the influence of contact chatter, respective bistable flip-flops having static inputs are controlled by each of the switches 20, 22, 48 and 34 through two conductors, whereby contact chatter resulting in short-time contact breakings does not affect the electronic control circuit. These bistable flip-flops are bistable flip-flop 56 associated with slider contact 20, flip-flop 58 associated with counting contact 22, flip-flop 60 associated with trigger 48 and flip-flop 62 associated with manual charging switch 34. Operation of trigger 48 sets bistable flip-flop 60, and an L-signal appears at the output 64 thereof which is connected to one input of NAND-gate 66. Input 36 for external triggering is connected to the other input of NAND-gate 66 and is normally L. Upon operation of trigger 48, there will be a step from L to O at the output of NAND-gate 66.

The output of NAND-gate 66 is connected to one input of a further NAND-gate 70 through an inverter 68. A second input of NAND-gate 70 is connected through conductor 72 to inhibit input 54 which is normally L. A third input of NAND-gate 70 is controlled by slider contact 20 and counting contact 22 through conductor 74. If both these contacts are closed, i.e. bistable flip-flops 56 and 58 produce L-signals at their outputs, the output of a NAND-gate 76, combining these flip-flop outputs, will be "O" and a signal L is applied to conductor 74 through an inverter 78. The output from NAND-gate 70 will then be "O", which is inverted to L by an inverter 80. This L-signal is applied to one input of a NAND-gate 82, the other input of which is connected to the metastable output of a monostable flip-flop 84. If monostable flip-flop 84 is triggered through its dynamic input, as will be described hereinbelow, it supplies a pulse, which NAND-gate 82 under the conditions described allows to pass in inverted form. This inverted pulse is again inverted by means of inverter 86 and triggers a power amplifier 88. Power amplifier 88 supplies a firing current pulse to the shot cartridge through conductor 90 (FIG. 1) and contacts 12 and 14, the shot cartridge being fired thereby.

In order to trigger the first shot, the output of NAND-gate 66 is, at first, applied through conductor 92 and a differentiating network 94 to the input of a NAND-gate 96. The other input to this NAND-gate is, in this condition, L, whereby the L-impulse from differentiating network 94, which effectively differentiates the switching-on step of trigger 48, is able to trigger the dynamic input of a monostable flip-flop 98. This monostable flip-flop 98 triggers the dynamic input of the monostable flip-flop 84 with a firing current control pulse through conductors 100, 102, whereby, as described, the firing current for the first shot is generated. The logic circuit combining the control signals from flip-flops 112 and 114, namely, NAND gates 138 and 96, has the characteristic of an AND gate. Thus, if both inputs to NAND gate 138 are L, its output becomes 0 and this is inverted, by NAND gate 96 to L. The second input to NAND gate 96 is normally L so that gate 96 normally has the function of an inverter.

If the shot has been properly fired, contacts 20 and 22 will open. The breech-mechanism ejects the cartridge case and feeds a new cartridge to the barrel, contacts 20 and 22 are closed and the weapon is again operative for the next shot. This shot is triggered automatically as follows:

The stable output of the monostable flip-flop 84 which, upon triggering by the firing current control pulse, triggers the firing current pulse, is connected to one input of a NAND-gate 106 through a conductor 104. Normally there is an L-signal at the stable output of flip-flop 84, and, with the trigger 48 closed, there is also an L-signal from the output of NAND-gate inverter 68 applied through conductor 108 to the other input of NAND-gate 106. The output from NAND-gate 106 is then in the state of "O", and an L-signal is obtained at the reset inputs of the two bistable flip-flops 112 and 114 through an inverter 110. When the monostable flip-flop 84 is triggered, its stable output is "O" during its hold time, i.e. during the occurrence of the firing current pulse. The output of NAND-gate 106 is then changed to L and the output of inverter 110 to 0. Thereby bistable flip-flops 112 and 114 are reset after each firing current pulse. Upon opening of contacts 20 and 22 during the shot the output of NAND-gate 76 becomes "L" and the output of the inverter 78 becomes "O".

Thereby the output of inverter 80 temporarily becomes O, and thus the gate circuit comprising NAND-gate 82 and inverter 86 is closed. Therefore positively no firing current pulse can be applied to the shot cartridge, as long as at least one of the contacts 20 and 22 is open.

The output from NAND-gate 76 and inverter 78 is applied to the dynamic input of bistable flip-flop 112 through conductor 116. When this output changes from O to L after contacts 20 and 22 have been opened and closed again, the bistable flip-flop 112, reset by the firing current pulse, will be set again. Thus bistable flip-flop 112 will be set after each shot, when and only when contact 20 has been opened and then has been closed again. The firing current control impulse from the output of the monostable flip-flop 98 is applied in parallel to the dynamic inputs of two monostable flip-flops 118, 120. These inputs respond, as shown, to changes from L to O, i.e. the flip-flops 118 and 120 are triggered by the falling slope of the firing current control pulse. Monostable flip-flops 118 and 120 have different hold times of, for example, 40 milliseconds and 13.3 milliseconds, respectively. The stable outputs of flip-flops 118 and 120 are connected to a NAND-gate 126 respective NAND-gates 122 and 124. NAND-gates 122 and 124 are controlled in opposite sense by a switch 128 and a voltage applied to control conductor 130 through resistor 132 and by an inverter 134. If switch 128 is closed, an L-signal is applied to conductor 130 and NAND-gate 124 has normally "L" at both inputs. Its output is "O". NAND-gate 122 has signal "O" at one input through inverter 134, and its output is "L". Thus NAND-gate 126 has O applied to one input and L applied to the other one. Its output is, therefore, O. During the hold time of the monostable flip-flop 120, the stable output thereof is O. Thereby the output of NAND-gate 124 becomes L, so that L-signal is applied to both inputs of NAND-gate 126 and the output thereof becomes O. The state of the monostable flip-flop 118 has, however, no influence on the output of NAND-gate 122, as one input of NAND-gate 122 is always O and thus its output is L.

Thus NAND-gate 126 normally produces the signal L and, during the hold time of monostable flip-flop 120, the signal "O". Bistable flip-flop 114, which had been reset by the preceding firing current pulse through conductor 104, is again set by the end slope of the pulse through conductor 136.

If switch 128 is opened, the signal "O" is applied to conductor 130 and the signal L is applied to NAND-gate 122 through inverter 134. Now the monostable flip-flops 118 and 120 interchange their functions, and the pulse from the output of NAND-gate 126 is determined by the monostable flip-flop 118. Thus switch 128 determined how quickly after the last firing current control pulse the bistable flip-flop 114 is set again, and thereby a rate of firing is preselected. In one embodiment of the invention opening of switch 128 results in a rate of firing of 1000 per minute and closing switch 128 results in a rate of firing of 1800 per minute.

When both monostable flip-flops 112 and 114 are set again, the signal L is applied to both inputs of a NAND-gate 138 connected to the outputs of the flip-flops. The output of this NAD-gate 138 becomes O and the signal, again inverted by NAND-gate 96, changes from O to L. Thereby the monostable flip-flop 98 is triggered again, flip-flop 98 producing the firing current control pulse and triggering, in the manner described hereinbefore, the firing current pulse to the shot cartridge.

Depending on whether the inherent rate of firing of the weapon is larger or smaller than the rate of firing preselected by switch 128 and monostable flip-flops 118 and 120, either the bistable flip-flop 112 or the bistable flip-flop 114 will be set first. At any rate, the new firing current pulse will be triggered only when both these monostable flip-flops have been set. In the former case, the weapon operates at the preselected rate of firing, in the latter case it operates at its inherent rate of firing (which would then be smaller than the preselected rate of firing), i.e. as quick as it can.

A restartable monostable flip-flop 140 is triggered by the firing current control pulse through conductors 100 and 102, the hold time of flip-flop 140 being reliably longer than the maximum occurring firing lag of the cartridges used and amounting, for example, to 300 milliseconds. As long as the weapon operates faultlessly, firing current control pulses are permanently produced at intervals smaller than 300 milliseconds. Thus the monostable flip-flop remains in its metastable state.

If the shot cartridge 16 does not fire in spite of a firing current pulse, the bistable flip-flop 112 will be reset but will not be set again due to the working cycle of slider contact 20 failing to take place. Consequently the firing current control pulse from the monostable flip-flop 98 fails to appear. The monostable flip-flop 140 remains in its metastable state during a safety period of 300 milliseconds and returns then into its stable state.

The falling slope thereby occurring in the output signal from monostable flip-flop 140 is differentiated by means of a differentiating network 142 and the pulse thus obtained is applied through an inverter 144 as L-pulse to one input of a NAND-gate 146. The other input of NAND-gate 146 is connected to the output of NAND-gate inverter 80. This latter output is L, if the trigger 48 is actuated and the slider and counting contacts are closed, as if a shot is to be fired and the weapon ought to be operative. This would be the case of a failing cartridge. An O-pulse appears then at the output of the NAND-gate 146, this output impulse being inverted by a further NAND-gate 148 and triggering a monostable flip-flop 150 through a dynamic input thereof.

Monostable flip-flop 150 produces a pulse which is applied to a power amplifier 156 through a NAND-gate 152 and a series connected inverter 154, power amplifier 156 producing a firing current pulse on conductor 30 to the charging cartridge 28 (FIG. 1). The second input of NAND-gate 152 is connected to the stable output of monostable flip-flop 84, whereby the firing current pulses to shot cartridge and charging cartridge are interlocked.

Thus if a cartridge has not yet fired 300 milliseconds after the firing current control signal on conductor 100, a charging cartridge will be fired. Thereby the slider contact will be opened and closed again, whereby bistable flip-flop 112 will be set and the operating cycle described above can go on.

Manual charging can be effected by means of switch 34 and flip-flop 62. A change of state of the bistable flip-flop 62 is differentiated by a differentiating network 158, and the pulse thus obtained is inverted by inverter 160 and applied, as an L-pulse, to the NAND-gate 162. The other input of NAND-gate 162 is connected to the output of the bistable flip-flop 56 this output being L, when slider contact 20 is closed. Normally the output of NAND-gate 162 forming the input to NAND-gate 148 is "L". Insofar NAND-gate 148 normally acts as an inverter. If, however, a manual charging is triggered by switch 34 and slider contact 20 is closed, the output from NAND-gate 162 becomes "O", the output of NAND-gate 148 flips to the state "L" and a charging process is also triggered, in the manner described, through monostable flip-flop 150. Manual charging is also possible when the counting contact 22 remains open.

In order to avoid malfunctions when the device is switched on, the inputs of the power amplifiers 88 and 156 are connected through diodes 164 and 166, respectively, to the inputs of flip-flops 60 and 62, respectively, corresponding to the inoperative state, these inputs being controlled directly by the associated mechanical switches 48 and 34, respectively. Thereby firing current impulses are automatically shunted when these switches are not operated.

The output of bistable flip-flop 58, which is controlled by the counting contact 22, is connected through a differentiating network 168 to the input of a monostable flip-flop 170. The monostable flip-flop produces counting pulses fed to a shot counter, which preferably is a down counter and indicates the number of shots still available.

We claim:

1. A device for controlling the firing current of a blow-back operated, electrically fired quick-firing weapon, comprising a signal transmitter signalling the closed position of the slider of said weapon, said device comprising, in combination, a first circuit means for producing a firing current pulse; a second circuit means responding to the movement of said slider away from and back to its closed position and producing a first control signal only after completion of such an away from and back movement of said slider; a third circuit means triggered by said firing control pulse through an electric time delay element and producing a second control signal; and a logic circuit having two inputs, to which said first and second control signals are applied, and having an output connected to said first circuit means to trigger a firing current control pulse.

2. A device for controlling the firing current of a blockback-operated, electrically fired quick-firing weapon, comprising a signal transmitter signalling the closed position of the slider of said weapon, said device comprising, in combination, a first circuit means for producing a firing current pulse; a second circuit means responding to the movement of said slider away from and back to its closed position and producing a first control signal only after completion of such an away from and back movement of said slider; a third circuit means triggered by said firing control pulse through an electric time delay element and producing a second control signal; and a logic circuit having two inputs, to which said first and second control signals are applied, and having an output connected to said first circuit means to trigger a firing current control pulse; said first circuit means comprising a monostable flip-flop which is connected to be triggered by said control signals through an AND gate.

3. A device as claimed in claim 2, in which a second monostable flip-flop is connected to be triggered by said firing current control pulse, the metastable output of said second monostable flip-flop being connected to control the firing current to a shot cartridge, and in which said second circuit means comprises a bistable flip-flop having a dynamic input and connected to be set by a signal from said slider monitoring signal transmitter and to be reset by a change of state of said second monostable flip-flop.

4. A device as claimed in claim 3, in which said third circuit means comprises a bistable flip-flop connected to be set by the output from a third monostable flip-flop upon return thereof to its stable state, said third monostable flip-flop being triggered by the firing current control pulse and serving as said time-delay element, said bistable flip-flop being further connected to be reset by a change of state of said second monostable flip-flop.

5. A device as claimed in claim 4, in which two monostable flip-flops, having respective different hold times, are connected to be triggered, in parallel by said firing current control pulse, and a controlled gating circuit connecting the bistable flip-flop of said third circuit means to the output of one of said last-named monostable flip-flop for selective setting of said bistable flip-flop of said third circuit means.

* * * * *